United States Patent [19]

Geary

[11] Patent Number: 4,842,483

[45] Date of Patent: Jun. 27, 1989

[54] PROPELLER AND COUPLING MEMBER

[76] Inventor: Edwin S. Geary, P.O. Box 1246, Fajardo, P.R. 00648

[21] Appl. No.: 116,358

[22] Filed: Nov. 4, 1987

Related U.S. Application Data

[63] Continuation-in-part of Ser. No. 882,171, Jul. 7, 1986, abandoned.

[51] Int. Cl.[4] ..... B63H 1/20

[52] U.S. Cl. ..... 416/93 A; 416/2; 416/241 A; 416/244 B; 416/245 A

[58] Field of Search ..... 416/93 A, 93 M, 134 R, 416/169 C, 241 A, 244 B, 245 A, 2; 464/89

[56] References Cited

U.S. PATENT DOCUMENTS

| | | | |
|---|---|---|---|
| 3,307,634 | 3/1967 | Bihlmire | 416/134 R X |
| 3,318,388 | 5/1967 | Bihlmire | 416/134 R X |
| 3,477,794 | 11/1969 | Abbott et al. | 416/134 R X |
| 3,701,611 | 10/1972 | Lambrecht | 416/241 A X |
| 4,477,228 | 10/1984 | Duffy et al. | 416/241 A |
| 4,566,855 | 1/1986 | Costabile et al. | 416/93 X |
| 4,676,758 | 6/1987 | Dennis | 416/93 A X |

FOREIGN PATENT DOCUMENTS

| | | | |
|---|---|---|---|
| 72384 | 11/1976 | Australia | 416/93 A |

*Primary Examiner*—Everette A. Powell, Jr.
*Attorney, Agent, or Firm*—Joseph P. Lavelle

[57] ABSTRACT

Disclosed is a marine propeller for inboard, outboard, or inboard/outboard motors. The propeller is made from a non-metallic composite material that will not deform or deflect even at very high horsepower or RPMs. At the same time, the propeller is substantially less expensive than traditional metallic propellers. An especially unique feature of the propeller is that, unlike metallic propellers, it will shatter when it strikes a solid object in the water, thereby avoiding the engine and drive line damage that occurs when rigid metallic propellers strike a solid object. Also disclosed is a coupling member that permits the propeller to be adapted for use with most inboard/outboard motor configurations.

10 Claims, 3 Drawing Sheets

PROPELLER AND COUPLING MEMBER

BACKGROUND OF THE INVENTION

This application is a continuation-in-part of Ser. No. 882,171, filed 7-7-86 now abandoned.

1. Field of the Invention

This invention relates to screw-type propellers and, in particular, to non-metallic propellers for marine use. The invention further relates to coupling members used to adapt non-metallic marine propellers to various engine/driveline configurations.

2. Description of the Related Art

Metallic propellers, such as propellers made from stainless steel, bronze, or cast aluminum, have long been used for marine applications. In the past, metallic propellers have been considered necessary in the art, particularly in high performance applications, in order to prevent deflection or deformation of the propeller blades at high RPMs with the attendant power loss incurred. However, the shortcomings of metallic propellers are well recognized in the art. Metallic propellers are extremely expensive to forge and manufacture. Moreover, metallic blades are highly susceptible to corrosion through electrolysis and cavitation, as the art has long recognized. Perhaps most significantly, however, rigid metallic propellers possess by design little flexibility. Thus, when a metal propeller strikes a rigid object in the water (for example, a reef), the propeller does not absorb the force of the impact but rather transmits the force to the engine and driveline. Thus, contact with a solid object can, and frequently does, result in costly, time consuming damage to the vessel's engine, transmission, and/or driveline. To attempt to address this problem, numerous devices have been devised to absorb a part of the impact force when a metallic propeller strikes a metal object. See, e.g., British Patent No. 1,409,911 (1971); Lambrecht, U.S. Pat. Nos. 3,701,611 (1970); Bihlmire, U.S. Pat. No. 3,318,388 (1967); Abbott, U.S. Pat. No. 3,477,794 (1967); and Novak, U.S. Pat. No. 3,256,939 (1966). However, all of these devices are expensive, have not been commercially manufactured to the best of applicant's knowledge, and provide only a partial solution to the problem.

Plastic propellers have been developed to attempt to remedy certain of the deficiencies in metallic propellers. Plastic propellers are lighter, simpler and less expensive to manufacture, and less subject to corrosion than metallic propellers. Further, a propeller made of an appropriate plastic is not as subject to permanent deformation as is a metal propeller. While contact with underwater objects may cause a portion of the propeller blade to shear or chip away, it is more resistant to chipping or shearing than a metal propeller is to a bending or deformation of its blade edges. Due to the reduced weight of the plastic material, any chips or nicks which do occur have considerably less effect upon the balance of the propeller than deformation or loss of material of its metal counterpart.

The principal drawback in plastic propellers is that they have not been capable of manufacture with a sufficient strength and rigidity to prevent deformation at moderate to high power and blade RPMs. As a result, these propellers have been useful only in low power, low performance engines. For example, U.S. Pat. No. 3,224,509 (1965) discloses a boat propeller made from a thermoplastic polycarbonate resin marketed under the trademark LEXAN. The LEXAN material has a modulus of elasticity (a measure of strength and stability) of only about 320,000 p.s.i. Such a propeller is useful only for low power applications. At high speeds, the blades will deform, causing loss of power and performance. While performance can be improved by using composite materials, such as glass reinforced mixtures of polyamide co-polymers, marketed by duPont under the trademark ZYTEL (see, e.g., Frazzell Austr. Patent No. 72,384 (1974)), experimentation has shown that ZYTEL-manufactured propellers also cause far too much deflection for use in high performance propeller application.

What is needed is a propeller that will resist deformation, as well as, or better than, metallic propellers, yet will possess the cost and other advantages of plastic propellers and will solve the problem caused when metallic propellers strike a solid object.

Therefore, it is an object of this invention to provide a non-metallic propeller that will perform at high speeds without deformation.

It is another object of this invention to provide a marine propeller that will shatter upon impact with a solid object in the water and thereby avoid damage to the vessel's engine, transmission, or driveline.

It is a further object of the invention to provide a propeller that can be used in numerous different engine/driveline configurations from different manufacturers where the interchangeability is provided by a coupling device designed to secure the propeller to the drive shaft.

It is still another object of this invention to provide a non-metallic propeller that is impervious to gasoline, oil, and other materials in the water that contribute to decay or deformation of propellers, as well as being impervious to ultraviolet radiation, which is an important source of decay in prior art non-metallic propellers.

These and other objectives of the invention will become apparent from the following specification and drawings.

SUMMARY OF THE INVENTION

The invention comprises a screw-type propeller and a coupling member adapted to attach the propeller to the propeller shaft of a vessel. The coupling member is formed with an inner surface and an outer surface. The inner surface is formed with a first securing means for securing the coupling member to the propeller shaft; the outer surface is formed with a second securing means for securing the coupling member to the propeller. The two securing means are designed to allow easy attachment and removal of the propeller and coupling means from the propeller shaft. In the use of the inboard/outboard or standard outboard engine, the design may offer exhaust gas release through the coupling hub. It is apparent that by modifying the first securing means, the same propeller can be utilized in numerous different applications from numerous manufacturers simply by utilizing a different coupling member.

The propeller is manufactured in one-piece form in an injection molding process. The propeller comprises, in the preferred embodiment, a central core adapted to receive the coupling member, a cylindrical hub, and blades. The central core is attached to the hub through a series of axially extending splines. The splines are sufficiently strong to transmit the torque of the engine. However, upon contact with a solid object in the water, the splines will shatter, causing the hub to disengage from the central core. As a result, damage to the engine, driveline, and transmission of the vessel is avoided.

The propeller is manufactured from an appropriate non-metallic composite, the preferred material being marketed by duPont under the trademark RYNITE 555. The coupling member may be manufactured from RYNITE 555, and this is preferred, or may be made from a metallic materials.

DETAILED DESCRIPTION OF THE INVENTION

Figure 1:
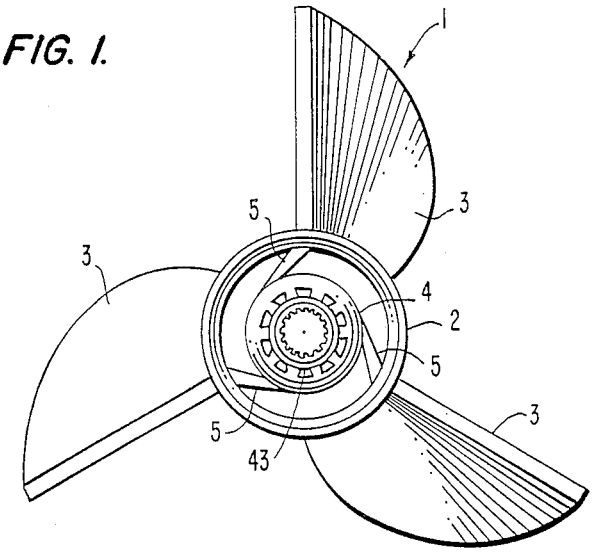
FIG. 1 is a front view of the preferred embodiment of this invention.

Referring to FIG. 1, a plastic propeller 1 having a central hub 2 and radially extending blade 3 is shown. The propeller blades and hub may be made as a single, integral piece or formed separately and attached in a known manner. In the preferred embodiment, the propeller blades and hub are injection molded into an integral construction. The shape, number and orientation of the blades will depend on the intended use of the propeller and in particular on the requirements of the user's vessel and the vessel's motive power. The design of these parameters will be apparent to one skilled in the art. The propeller of the present invention may be used both by large vessels with inboard motors and inboard/-outboard or outboard with engine speeds below 1000 RPMs, as well as with smaller vessels, with outboard motors and engine speeds of up to approximately 5000 RPMs.

Figure 4:
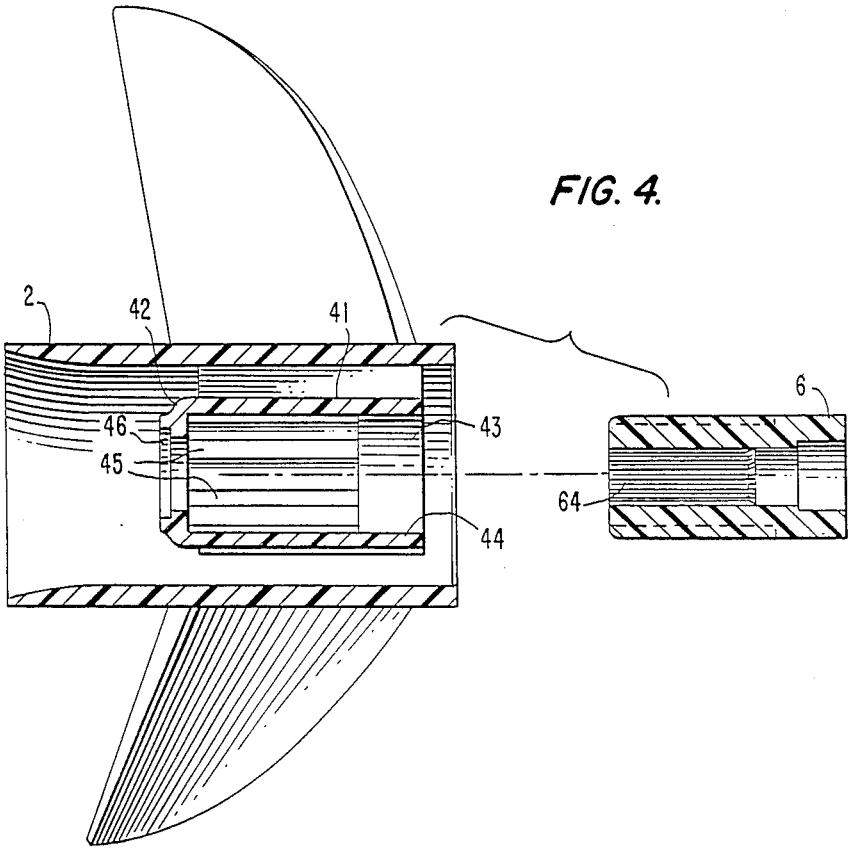
FIG. 4 is a cross-sectional view of the preferred embodiment.

In the preferred embodiment, a central core 4 is connected to the cylindrical shaped hub 2 by a series of axially extending splines 5. As best seen in FIG. 4, the core 4 defines an aperture 43 adapted to receive the coupling member. The coupling member 6 is press fit into the rear portion of the core 4 and is rendered substantially immobile because the aperature 43 in core 4 is designed to mate with the lateral surfaces of coupling member 6. The propeller assembly is placed onto the driveline of a motor attaching snugly to the driveline through the design of aperature 64 as more fully described hereafter. The propeller assembly is then secured to the driveline through a traditional lock-washer or other means provided by the engine manufacturer. The invention is adaptable to virtually all types of inboard and outboard motor/driveline configurations and requires no special manufacturing or design on the part of motor manufacturers.

In the preferred embodiment, the propeller and coupling member are each made in a one-piece injection molding process from a thermoplastic polymer resin marked by duPont under the name RYNITE 555. RYNITE 555 is a 55% glass-reinforced, modified polyethylene terephthalate ("P.E.T."). This material exhibits superior stiffness, dimensional stability and creep resistance. It possesses a tensile strength of 28,000 p.s.i. at 73° F., a flexural strength of 40,000 p.s.i. at 73° F., and a flexural modulus of 2,600,000 p.s.i. at 73° F. The RYNITE material is also substantially impervious to decay from ultraviolet radiation. Current grades of RYNITE resins contain mica and glass dispersed in P.E.T., formulated for rapid crystalization during the injection molding process. In the crystalization process, a chemical bond is formed between the P.E.T. and the mica/-glass particles and as a result the strength and stiffness of the composition is greatly enhanced.

The particular design of the propeller will of course depend on the application for which it is intended. By way of example, described herein is a 3-bladed, right-handed propeller for high performance outboard motors and inboard/outboard dives, designed to meet through or over the hub exhaust requirements.

Figure 2:
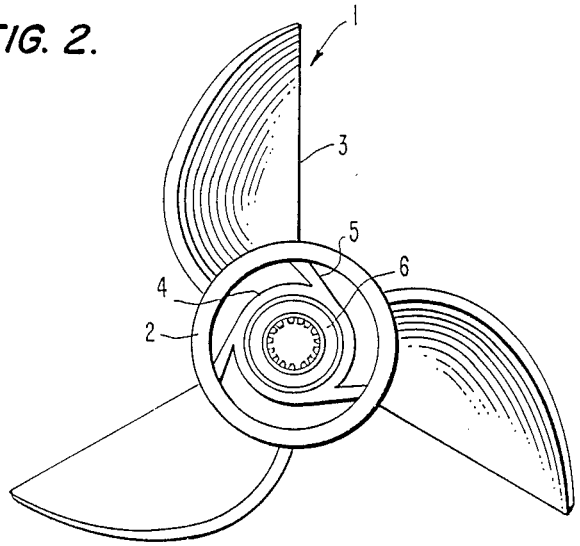
FIG. 2 is a rear view of the preferred embodiment of this invention.
Figure 3:
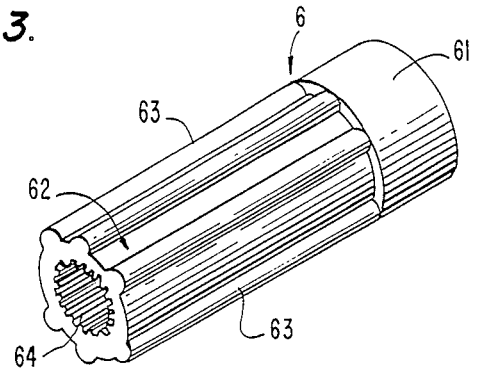
FIG. 3 is a perspective view of the coupling member of the preferred embodiment.

Referring to FIG. 4, the central core 4 has an outer diameter of $2\frac{1}{2}$ inches. The core has a cylindrical body 41 approximately $4\frac{1}{2}$ inches long and a tapered portion 42 that forms a template 46 adapted to mate with the lock-washer or other means provided by the manufacturer to secure the propeller to the driveline. Three radially extending splines 5 extend from the core 4 to the hub 2. The splines extend the entire length of cylindrical body 41 and are approximately 1 inch in width. The splines are tapered so that they are at their narrowest where they join the body 41 of core 4 as shown in FIG. 2.

The hub 2 has an outside diameter of about $4\frac{3}{4}$ inches and an inside diameter of about $4\frac{1}{4}$ inches. It may be desirable for the hub to taper slightly at its front end as shown in FIG. 4. The propeller blades 3 are shaped in well-known designs to adapt to the particular application desired. Here, the blades are shown in a 3-bladed 23 inch pitch application.

Referring to FIG. 4, it can be seen that the central core 4 defines an aperature 43 that is adapted to receive the coupling member 6 in a press-fit relationship. Aperature 43 contains a ring-shaped recessed portion 44 and a series of notched, semi-circular indentations 45. The semicircular notched openings are designed to receive and snugly secure the coupling member 6. The circular design of the notches makes the propeller easier to mold and reduces the friction between the coupling member and central core.

The coupling member 6 contains a ringed portion 61 having an outside diameter of $1\frac{3}{4}$ inches and a length of $1\frac{1}{4}$ inches. The body 62 of the coupling member has an outer diameter (D) of $1\frac{1}{2}$ inches. A series of extensions 63, semi-circular in cross-section, extend the length of body 62.

The coupling member 6 defines an inner aperature 64. The design of aperature 64 is dictated entirely by the design of the driveline for which the propeller is designed. It will be appreciated that by varying the design of aperature 64 the coupling member can be produced in a manner to fit virtually any motor/driveline configuration. Thus, the propeller's hub/blade assembly can be used with virtually any motor driveline configuration by merely choosing an appropriate coupling member. The cost saving to manufacturers and distributors from this feature is immediately apparent.

In operation the coupling member 6 is inserted into the aperature 43 in central core 4. The extensions 63 on coupling member 6 mate with the recessed notches 45. The ring portion 61 of coupling member 6 fits snugly into contact with recessed portion 44 of aperature 43. The coupling member thus is snugly and securely, but removably, secured to the central core. The propeller assembly is then placed onto a driveline through aperative 64 and secured for operation in a conventional manner.

The RYNITE 555 propeller is resistant to a wide variety of fluids, such as gasoline, motor oil, hydrocarbons, and solvents often found in the water. Thus, these chemicals will not cause the RYNITE propeller to decay. The RYNITE material also provides good acid and base resistance at normal water temperatures.

The unique ability of the propeller to shatter when it strikes a solid object in the water is effected principally by the design of the splines 5. Splines 5 will transmit the torque of the driveline to the hub 2 in normal operation. However, when the blades strike a solid object in the water, the splines 5 will shatter causing the central core 4 to be disengaged from the hub 2. IN this matter damage to the vessel's engine, transmission, and/or driveline is avoided.

If the propeller 1 is damaged by striking an underwater object, the lightweight propeller can be replaced either on shore or in he water by sliding the propeller off coupling member 6 and inserting a new propeller in its place. This operation is extremely simple and can be performed at sea, even on the largest vessels, by one or two divers wearing appropriate diving gear. Hence, the need to tow a vessel back to shore for dry docking, as well as the extensive down time need to repair prior art propellers, is greatly reduced or eliminated. However, the applicant presently prefers that the coupling member be replaced whenever the propeller shatters to avoid a situation where the impact with a solid object has caused an undetected, latent defect to arise in the coupling member.

Figure 5:
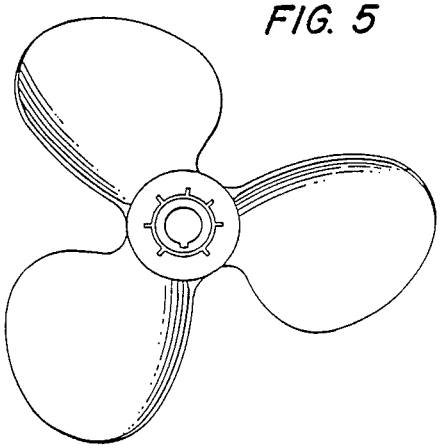
FIG. 5 is an elevational view of an alternate embodiment of the invention.
Figure 6:
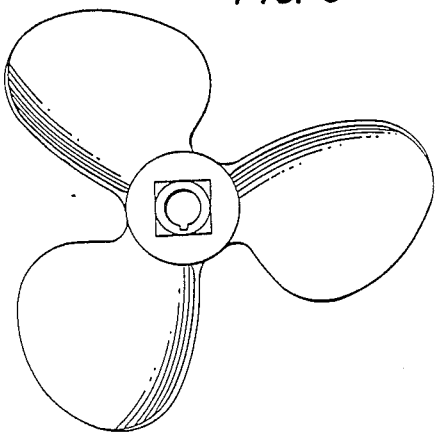
FIG. 6 is an elevational view of another alternate embodiment of the invention.
Figure 7:
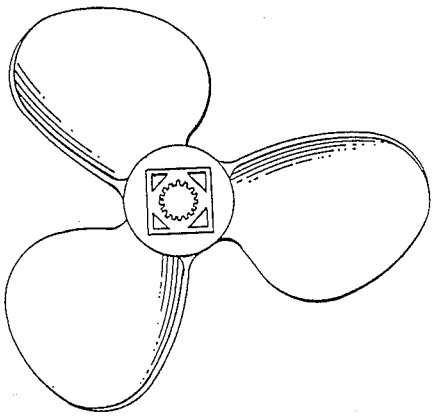
FIG. 7 is an elevational view of a third alternate embodiment of the invention.

It will be appreciated that other embodiments of the propeller/coupling member are possible consistent with the disclosure of this invention. FIGS. 4, 5, 6 show alternate embodiments that are not preferred at this time, but that may be desirable for certain applications.

While the principles of the invention have been described in connection with the embodiments specified above, this description has been made only by way of example and not as a limitation to the scope of the invention.

What I claim as new and desire to secure by Letters Patent of the United State is:

1. A two-piece, non-metallic, screw-type propeller that will shatter upon contact with a solid object in the water comprising:

(a) a rigid propeller member molded in one piece from thermoplastic resins comprising 55% glass and mica particles and 45% polyethylene terepthalate, said propeller member having
  (i) a central core having a base adapted to receive a coupling member;
  (ii) a cylindrical hub;
  (iii) a plurality of blades attached to the hub; and
  (iv) a plurality of splines that shatter upon contact with a solid object in the water said splines attached at one end to the central core and extending radially with the other end of said spline attached to the hub, and (b) a rigid coupling member having
  (i) an inner surface adapted to receive the driveline of a vessel;
  (ii) an outer surface adapted to fit snugly into, but removable from the base in the central core of the propeller member, and
  (iii) a means for securing said coupling member to the driveline, wherein said propeller member is removably secured to the coupling member such that the outer surface of the coupling member is in secure contact with the core in the coupling member, and said coupling member drives said propeller member.

2. The two-piece marine propeller of claim 1, wherein said propeller member is manufactured from RYNITE 555.

3. The two-piece marine propeller of claim 1, wherein said outer surface of said coupling member has a ringed portion at one end and a plurality of axially extending ribs.

4. The two-piece marine propeller of claim 2, wherein said ribs are semi-circular in cross-section.

5. The two-piece marine propeller of claim 1, wherein thee are a total of three splines.

6. A two-piece, non-metallic, screw-type marine propeller that will shatter upon contact with a solid object in the water, comprising:

(a) a rigid propeller member molded in one piece from thermoplastic polyester resins and comprising 55% glass and mica particles and 45% polyethylene terepthalate, said propeller having
  (i) a central core having a rigid base adapted to receive a coupling member;
  (ii) a cylindrical hub
  (iii) a plurality of rigid blades attached to the hub; and
  (iv) a plurality of splines that will shatter upon contact with a solid object in the water, said splines attached at one end to the central core and extending radially with the other end of said splines attached to the hub, and (b) a rigid coupling member removably secured to the propeller in a press-fit relationship with the bore in said propeller member and driving said propeller member, said coupling member having
  (i) an inner surface adapted to receive the driveline of a vessel;
  (ii) an outer surface adapted to fit snugly but removably into the base of the propeller member.

7. The propeller of claim 6 wherein said propeller is manufactured from RYNITE 555.

8. The propeller of claim 7 wherein the number of blades is three.

9. The propeller of claim 6 wherein the number of said splines is three.

10. The propeller of claim 9 wherein said splines are located at a tangent to said core.

* * * * *